US009433825B1

(12) United States Patent
Nguyen

(10) Patent No.: US 9,433,825 B1
(45) Date of Patent: Sep. 6, 2016

(54) SWIMMING AID DEVICE

(71) Applicant: Andrew Nguyen, Huntington Beach, CA (US)

(72) Inventor: Andrew Nguyen, Huntington Beach, CA (US)

( * ) Notice: Subject to any disclaimer, the term of this patent is extended or adjusted under 35 U.S.C. 154(b) by 0 days.

(21) Appl. No.: 14/688,796

(22) Filed: Apr. 16, 2015

(51) Int. Cl.
*A63B 31/11* (2006.01)
*A63B 31/08* (2006.01)

(52) U.S. Cl.
CPC ..... *A63B 31/11* (2013.01)

(58) Field of Classification Search
CPC ..... A63B 31/11; A63B 31/08
USPC ..... 441/61, 63, 64
See application file for complete search history.

(56) References Cited

U.S. PATENT DOCUMENTS

| | | | |
|---|---|---|---|
| 3,165,764 | A | 1/1965 | Christiansen |
| 3,521,312 | A | 7/1970 | Ganev |
| 4,781,637 | A | 11/1988 | Caires |
| 7,510,453 | B2 | 3/2009 | Nguyen |

*Primary Examiner* — Anthony Wiest

(57) ABSTRACT

This invention provides center locking means that are manufactured from harder materials for detachably coupling two swim fins for use by a swimmer practicing the dolphin kick. Also, the invention explains how to strengthen the center locking means to preserve longevity of use.

3 Claims, 4 Drawing Sheets

SWIMMING AID DEVICE

CROSS-REFERENCES

Nguyen U.S. Pat. No. 7,510,453 filed on Aug. 20, 2007, and issued on Mar. 31, 2009.

STATEMENT REGARDING FEDERALLY-SPONSORED RESEARCH OR DEVELOPMENT

None.

NAMES OF PARTIES TO JOINT RESEARCH AGREEMENT

None.

REFERENCE TO "SEQUENCE LISTING"

None.

SUMMARY OF INVENTION

The purpose of ordinary swim fins is to provide a device for increasing speed and mobility to a swimmer with the consumption of less energy. These devices are aimed at a swimming style which involves independent use of the legs. One style of swimming referred to as the butterfly, involves concerted use of the legs, commonly described as the dolphin kick. To maximize the efficiency, speed and power of the dolphin kick, both feet must be kept as close together as possible.

The present invention achieves the desired characteristic of keeping both feet close together, as a training device for swimmers.

Another object of the present invention is to provide a swimming aid device that allows the user to easily attach and detach the separate fins.

Another object of the present invention is to provide a swimming aid device that is relatively easy and inexpensive to manufacture.

Another object of the present invention is to provide a swimming aid device that can be modified and situated to accommodate various feet sizes of the user.

Another object of the present invention is to provide a swimming aid device that is relatively lightweight, durable and waterproof.

To accomplish these objectives, I have invented an improved process for detachably coupling the two fins. To promote longevity, the invention relies on a more durable coupling means which has a center locking mechanism. The locking mechanism is harder than the remainder of the composition of the fins. The locking mechanism has a hardness scale measured by durometer at about 90D (hereafter "hard" or "harder") whereas the foot pocket and balance of the fins further from the locking mechanism have a hardness measured on the durometer at about 60D.

The coupling means described in the preferred embodiment employs a hard center locking mechanism which can removably slide between grooves in the fins, sometimes referred to as a sliding key and groove coupling. Other coupling means included in my invention, can be described as peg and groove, latch and catch, zipper, opposite polar magnets, and key and lock. Additionally, other compositions of the coupling means, such as using a metal or plastic zipper slider and teeth of corresponding materials, are included in this invention.

DRAWINGS

4, Described as Follows

Figure 1:
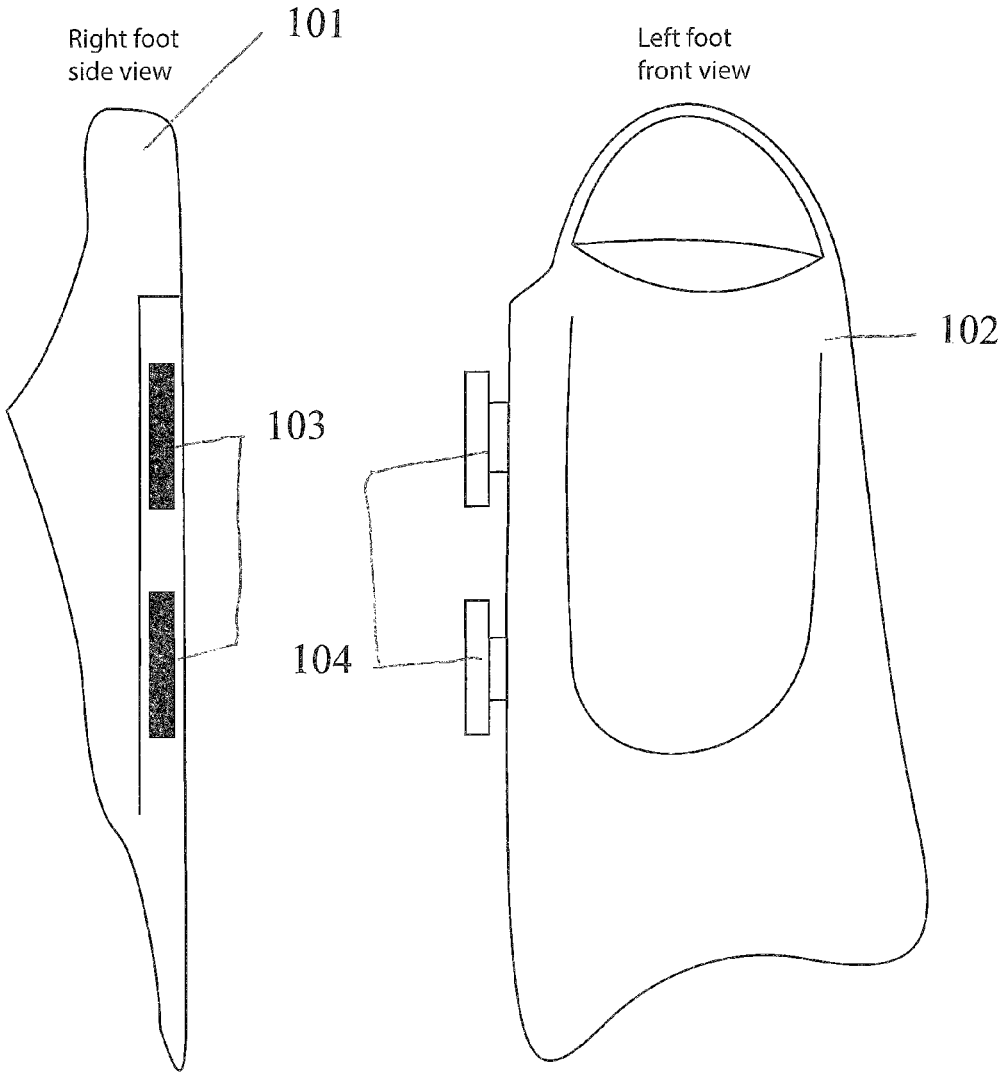

FIG. 1 contains a side and planar view of the peg and groove coupling.

Figure 2:
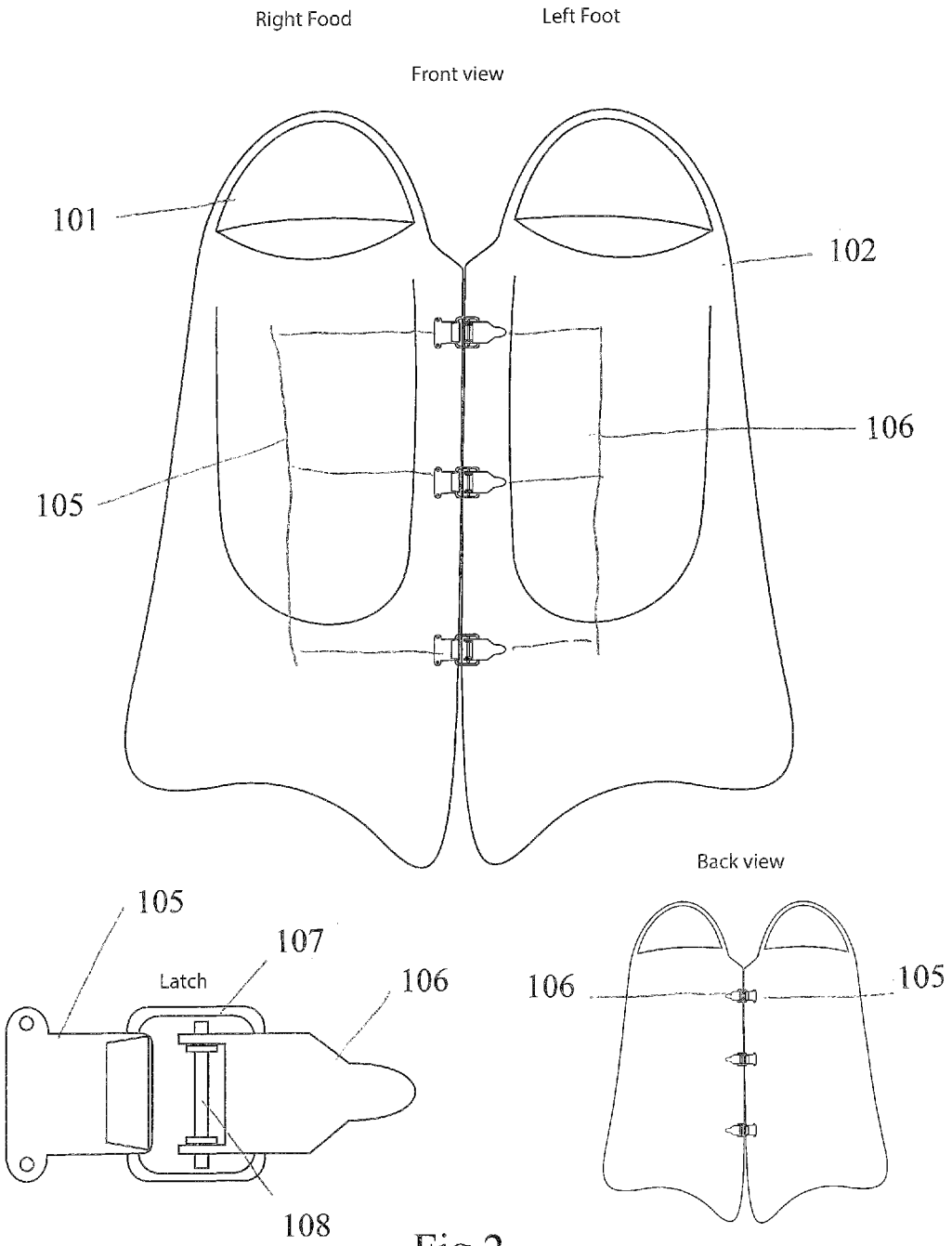

FIG. 2 contains a planar view of the latch and catch coupling, a close up view of the coupling and a back view.

Figure 3:
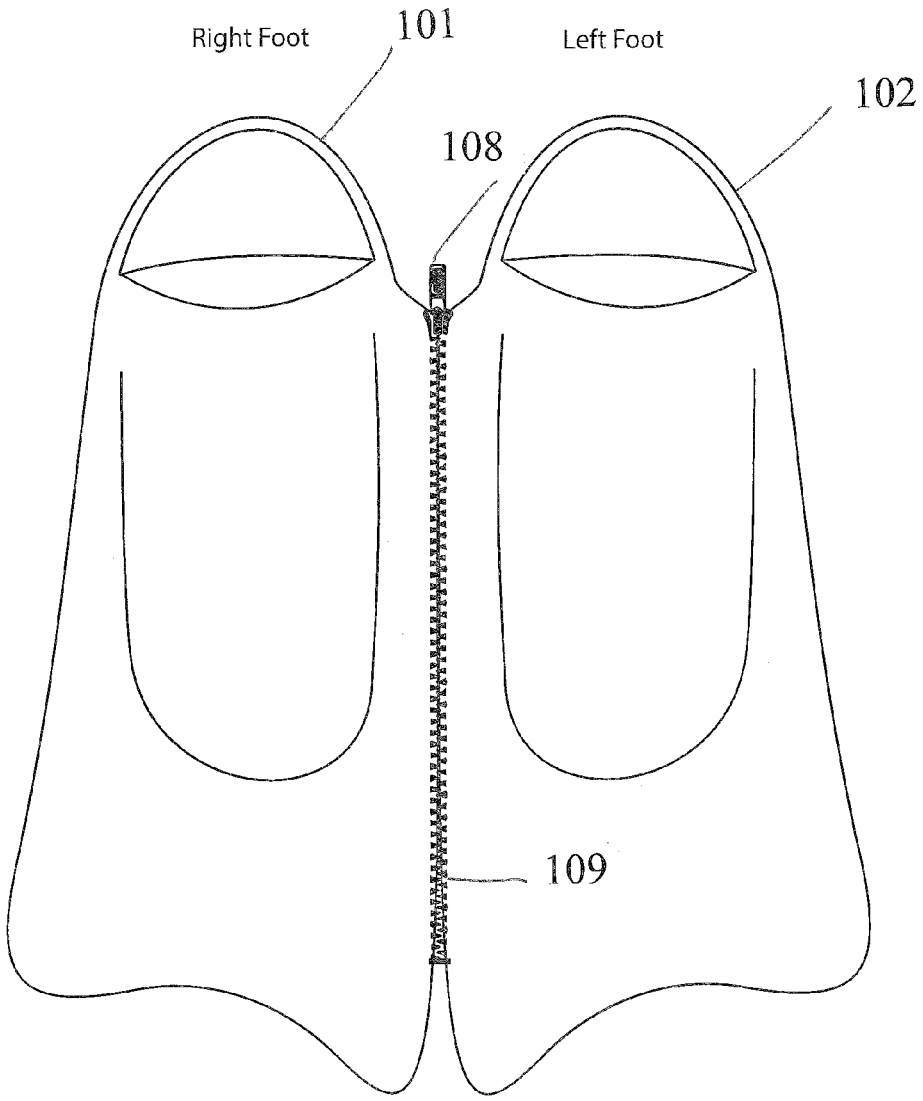

FIG. 3 contains a planar view of the zipper coupling.

Figure 4:
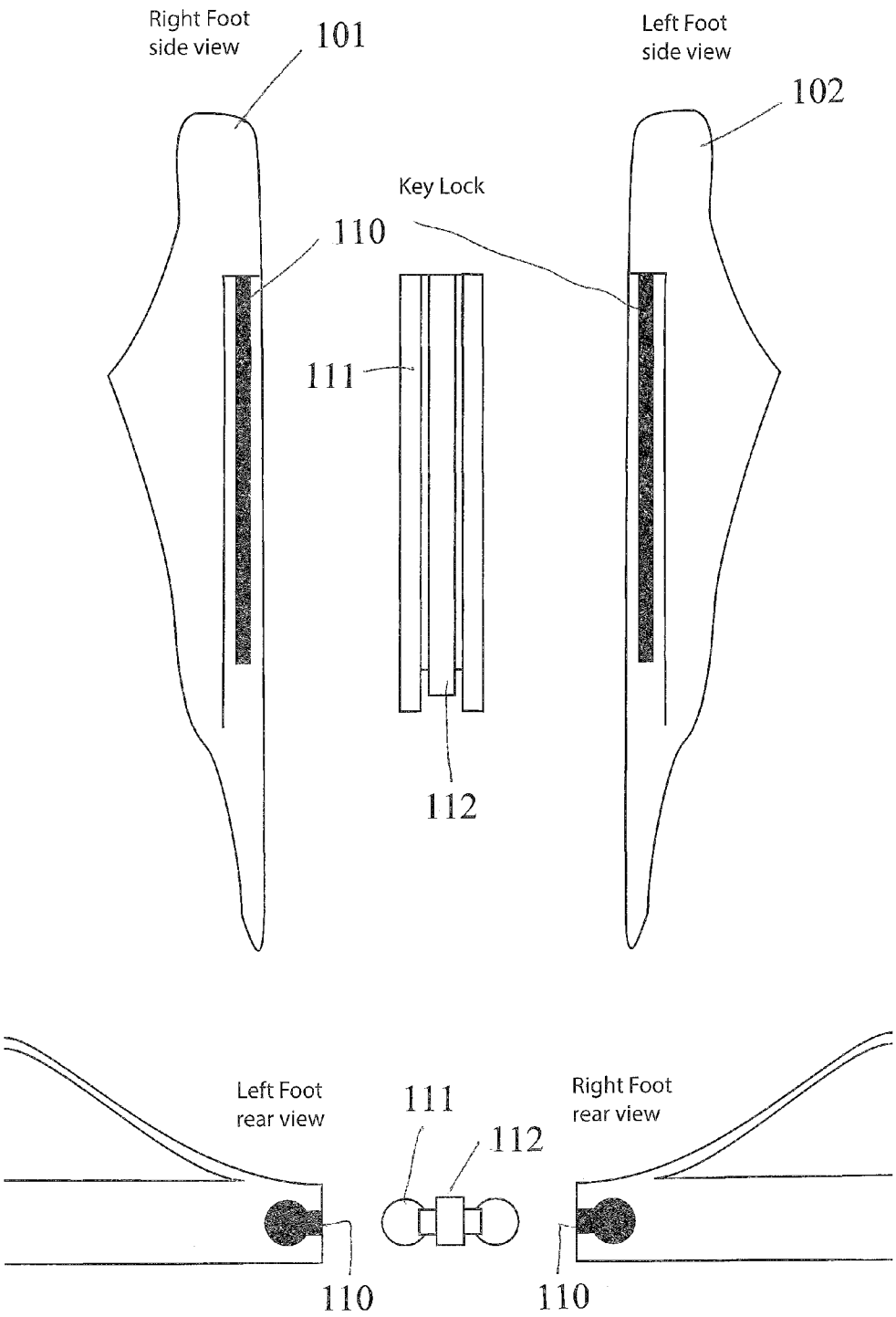

FIG. 4 contains a side view of the sliding key and groove coupling and a close up view of the coupling.

DETAILED DESCRIPTION OF DRAWINGS

The swim fins are composed of resilient material to allow for coupling and use in unison without failure due to force exerted upon the coupling. The central locking means, whether it is a sliding locking key with corresponding grooves in the fins, peg and groove mechanism, latch and catch mechanism, zipper mechanism, opposite polar magnets with one polar magnet installed on the inner edge of each fin, or sliding groove mechanism, is harder with durometer reading of about 90D, as compared to the remaining composition of the foot pockets and balance of the fins that have durometer reading of about 60D. The process for making the center locking means harder, involves making the center lock first. The center locking is made as mold material is injected into a mold and then allowed to harden. The center locking is also designed with fingerlike channels throughout, which do not appear in the remainder of the fins. Then softer, more rubber like material is poured around the harder center lock, which spreads into the fingerlike channels to create a strong connection between the harder center lock and the rest of the fins. This process is familiar to one of ordinary skill in the art of forming molded plastic and rubber components.

In FIG. 1 the first fin or right foot fin 101 has at least two rectangular slots 103 which are longitudinally spaced on a lateral side nearest to the second fin or left foot fin 102. The left fin has at least two slightly larger rectangular pegs 104 which are complementally spaced on a lateral side nearest to the right fin. When the rectangular pegs of the left fin are angled and then press fitted into the at least two slots on right fin they form a monofin which can later be detached. When attached the monofin is sufficiently strong to allow a wearer to use the monofin for swimming.

In FIG. 2 the right fin 101 has at least two keepers 105 which each have a permanently affixed first base. One edge of the first base is backwardly curved at an edge nearest to the left fin 102. The at least two first bases on the right fin are longitudinally spaced on a side nearest to the left fin 102. The left fin 102 has at least two latches 106 each with a permanently affixed second base and each pivotally connected to rotatable lever 108 which can be raised and lowered over a range of about 180° in order to extend a ring 107 which is also attached to the second base to catch on the backwardly curved edge of the affixed first base 105 on the right fin 101. The at least two latches 106 are complementally located on a lateral side nearest to the right fin 101. The latches and keepers can be closed on each other to detachably couple both fins. When closed they form a monofin.

In FIG. 3 the right fin 101 has a zipper slider 108 mounted on a permanently affixed row of teeth on a side nearest to the left fin 102. The left fin has a correspondingly, permanently affixed row of teeth 109 on a side nearest to the right fin. When the zipper slider 108 is moved upwardly from the toe of the right fin, the fins are detachably joined. The monofin is sufficiently strong to allow use as a swimming device.

It is further anticipated that the zipper slider can be made of metal or plastic, and the teeth will also be made from similar materials.

In FIG. 4 the right fin 101 has a longitudinal groove 110 on a side nearest the left fin 102, and the left fin has a correspondingly longitudinal groove on a side nearest the right fin. A rectangular key 112 with protruding lips 111 on opposing sides can be inserted in the corresponding grooves, to detachably couple both fins. When coupled the wearer can use the monofin as a swimming device.

The above description of the preferred embodiment of the present invention has been presented for the purposes of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims.

I claim:

1. A swimming aid device, comprising:

a first fin made of resilient material;

a second fin made of resilient material;

a center locking means made of harder material;

where each fin has a longitudinal groove on a perimeter edge, said longitudinal groove forming a keyed slot;

where each of said fins has an internal space capable of enclosing a portion of a swimmer's foot;

where each of said fins has an opening leading to said internal space capable of allowing a swimmer to insert a foot through said opening; and a means for coupling made of harder material where the center locking means is removably used to attach the fins to each other, by sliding an elongated, rectangular key with protruding keyed edges that mate with the correspondingly keyed slot of the longitudinal grooves in the first fin and the second fin.

2. The device of claim one, where the coupling means allows the first and second fins to form a monofin, with sufficiently strong coupling to allow a wearer to use the monofin for swimming.

3. The device of claim one, where an inner edge of each fin, meaning the edge of the first fin nearest the opposing edge of the second fin and the edge of the second fin nearest the opposing edge of the first fin, as well as the means for coupling, are manufactured of harder materials than the remainder of the fins which are comprised of softer materials.

* * * * *